United States Patent [19]

Kriechbaum

[11] Patent Number: 4,885,442

[45] Date of Patent: Dec. 5, 1989

[54] CONTACT ELEMENT

[75] Inventor: Karl Kriechbaum, Kassel, Fed. Rep. of Germany

[73] Assignee: AEG Aktiengesellschaft, Frankfurt, Fed. Rep. of Germany

[21] Appl. No.: 132,240

[22] Filed: Dec. 14, 1987

[30] Foreign Application Priority Data

Dec. 24, 1986 [DE] Fed. Rep. of Germany ..... 3644453

[51] Int. Cl.[4] ..... H01H 33/66

[52] U.S. Cl. ..... 200/144 B; 200/148 B

[58] Field of Search ..... 200/144 B, 148 B

[56] References Cited

U.S. PATENT DOCUMENTS

| | | | |
|---|---|---|---|
| 3,275,777 | 9/1966 | Planz et al. | 200/144 B |
| 3,327,081 | 6/1967 | Pflanz | 200/144 B |
| 3,372,259 | 3/1968 | Porter | 200/144 B |
| 3,845,262 | 10/1974 | Hundstad | 200/144 B |
| 4,415,787 | 11/1983 | Yamanaka | 200/144 B |
| 4,453,054 | 6/1984 | Peche et al. | 200/144 B |

FOREIGN PATENT DOCUMENTS

| | | |
|---|---|---|
| 0055008 | 3/1981 | European Pat. Off. . |
| 0076659 | 10/1982 | European Pat. Off. . |
| 758950 | 4/1952 | Fed. Rep. of Germany . |
| 1236053 | 3/1967 | Fed. Rep. of Germany . |
| 2321753 | 11/1973 | Fed. Rep. of Germany . |
| 2626245 | 12/1977 | Fed. Rep. of Germany . |
| 3107155 | 9/1982 | Fed. Rep. of Germany . |
| 3401497 | 8/1984 | Fed. Rep. of Germany . |
| 1483899 | 1/1974 | United Kingdom . |
| 1476964 | 6/1974 | United Kingdom . |
| 2111309 | 12/1982 | United Kingdom . |

*Primary Examiner*—Robert S. Macon

*Attorney, Agent, or Firm*—Spencer & Frank

[57] ABSTRACT

A contact element for a power switch which, in order to open or close the switch, cooperates with an opposite element, with a transitory rotating electric arc forming between the contact element and the opposite element when the switch is operated. The contact element has an electrode part which includes a portion made of an electrically conductive material. This portion defines a contact surface, with the electrode part having a defined width and being curved in the direction of the width to have the form of an open loop having a connecting end and a free end. A current may be introduced approximately tangentially to the open loop at its connecting end, and the free end is spaced from the connecting end in the direction toward the interior of the loop by a distance which is less than the defined width.

12 Claims, 3 Drawing Sheets

FIG.1
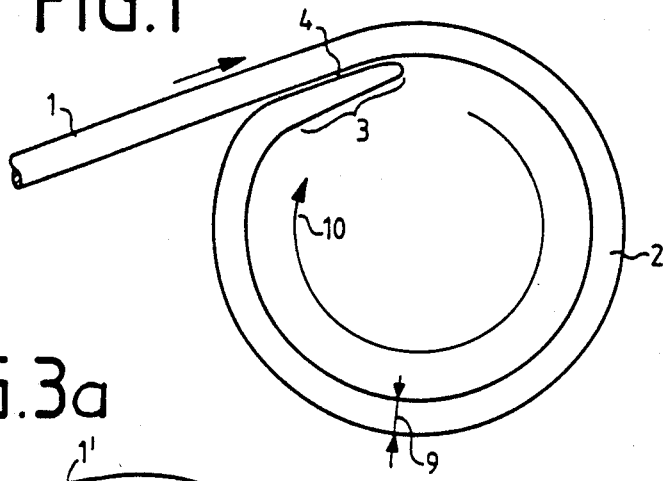
FIG.3a
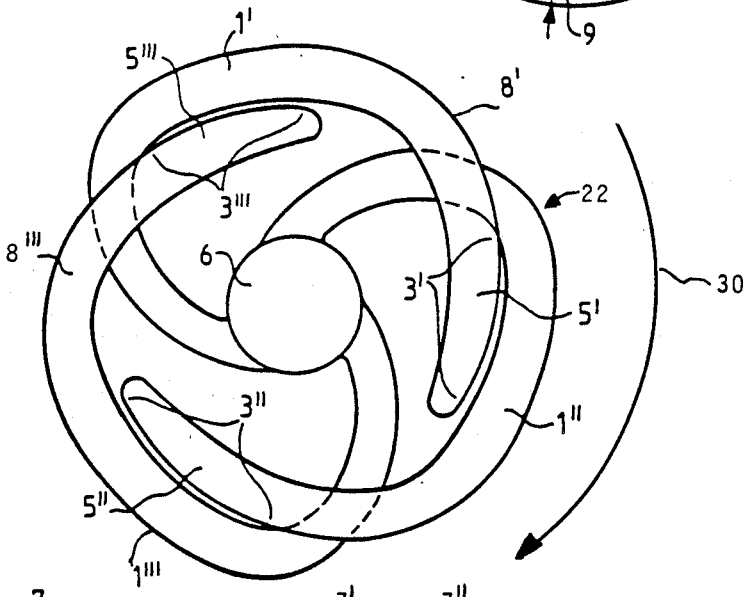
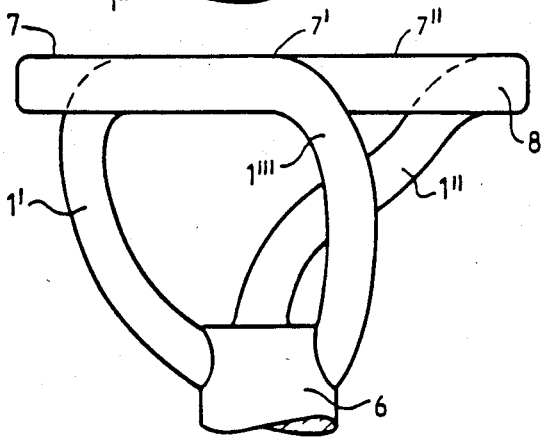
FIG.3b

CONTACT ELEMENT

BACKGROUND OF THE INVENTION

The present invention relates to a contact element for a power switch which, in order to open or close the switch, cooperates with an opposing contact element that has the shape of a ring and in which a rotating electric arc forms when the switch is opened.

Electric arcs cause the base points of the electrodes to be heated considerably. To realize low consumption, particularly with strong current arcs, means must be provided to cause the base points of the arcs not to form at one point on the electrodes but to move over the surface of the electrodes.

It is known to configure contact elements for vacuum switches so that a thick-walled hollow cylindrical contact element is provided which has cuts distributed over its circumference, with such cuts, seen from the top, extending at an angle to the radii and, seen from the side, obliquely toward the normal on the contact surface.

If an arc burns between such contact elements, a force component is created on the arc which causes the arc to rotate. However, the arc moving from one such segment over a cut to the next segment causes great consumption at the edges of the segments.

A modification of this embodiment is disclosed in the in-house periodical of AEG, "Vakuum-Leistungsschalter—ein neuer Weg im Bereich der Mittelspannung", [Vacuum Power Switches—A New Way In The Medium Voltage Domain], A 24.05.15/0381, page 8. This improvement provides a ring at the frontal face of the hollow cylindrical contact element, i.e. in the contact region. Although this results in less consumption, it also results in unsatisfactory operation. Reliable rotation of the arc at a rate of rotation sufficient to reduce consumption cannot be realized with relatively low current intensities. The arc rotates reliably and at a sufficient speed only if a comparatively high current is exceeded because a component of the current flows through the ring of such an arrangement, also in a direction opposite to the rotary movement, annd this component causes electromagnetic forces to be generated which counteract the rotation of the arc.

SUMMARY OF THE INVENTION

It is an object of the invention to make available contact elements in which consumption is reduced in that measures are taken with which rotation of the arc is reliably ensured even at relatively small current intensities, at a greater rate of rotation than in the prior art embodiments.

This is accomplished, according to the present invention, by a contact element for a power switch which, in order to open or close the switch, cooperates with an opposite element, with a transitory rotating electric arc forming between the contact element and the opposite element when the switch is operated, comprising an electrode part which includes a portion made of an electrically conductive material, with this portion defining a contact surface. The electrode part has a defined width and is curved in the direction of the width to have the form of an open loop spaced from the connecting end in the direction toward the interior of the loop by a distance which is less than the defined width.

Another solution of this problem according to the invention resides in providing a contact element for a power switch which, in order to open or close the switch, cooperates with an opposite element, with a transitory rotating electric arc forming between the contact element and the opposite element when the switch is operated, comprising a plurality of sections, each section having an electrode part which includes a portion made of an electrically conducting material. This portion defines a contact surface, with the electrode part having a defined width and being curved in the direction of the width to have the form of an open loop, spaced from the connecting end of an adjacent section in the direction toward the interior of the loop by a distance which is less than the defined width.

The switching capability of a switch equipped with contact elements according to the invention is substantially increased by reliable rotation of the arc. This advantage is realized because one or both of the contact elements are configured as a loop having one or a plurality of insulating gaps which produce a current flow only in the direction of rotation. Thus, the generation of an electromagnetic force to counteract the rotation of the arc is prevented. As a result, even if current intensities are comparatively low, continuous rotation is realized at a velocity sufficient to reduce electrode consumption.

The invention is based on the following realization:

Due to the Lorentz forces, an arc between two parallel conductors moves into a direction which is opposite to the direction from which the current leads are brought to the conductors. This travel of the arc remains in effect even if the conductors are bent into a circle. Rotation is realized if the loop is open and the arc itself bridges the gap between beginning and end of the loop. Extensive tests have shown that consumption of the electrodes at this gap can be avoided only if the current transfer is not perpendicular to the gap but occurs in an overlap region in which the end of the loop inwardly overlaps with the beginning of the loop.

Other features of the invention, which are defined in the dependent claims, relate to suitable embodiments and further advantages.

The invention will now be described with reference to the drawing figures.

BRIEF DESCRIPTION OF THE DRAWINGS

FIG. 1 is a schematic representation of an electrode as a one-piece open loop.

FIG. 3*a* is a top view and FIG. 3*b* a side view of the basic configuration of a contact element composed of three sections.

FIG. 4 is a schematic representation of an electrode in the shape of a carrera curve.

DESCRIPTION OF THE PREFERRED EMBODIMENTS

Figure 2A:
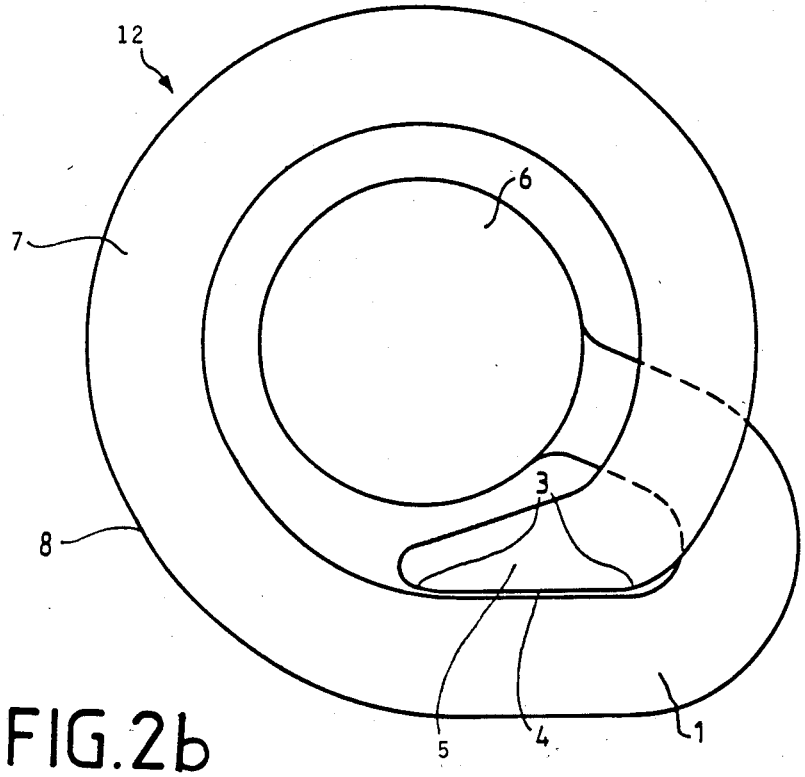
FIG. 2*a* is a top view and FIG. 2*b* a side view of the basic configuration of a contact element equipped with an electrode according to FIG. 1.

FIG. 1 is a schematic representation of the configuration of a contact element in the form of an open loop to explain the idea of the invention. A loop 2 made of an electrically conductive material forming the electrode has an approximately circular shape; current is conducted tangentially through a connecting end 1. The circular loop 2 does not close metallically; instead, in an overlap region 3, the open end of loop 2 inwardly approaches the starting region of this loop at a distance 4 which is small compared to a width 9 of the electrode. This distance 4 extends over the entire overlap region 3.

An arc, which forms perpendicularly to the plane of the drawing between the contact element and a similar contact element or a plate-shaped contact element, when the power switch is opened, is moved by the Lorentz force in the direction of arrow 10 and passes beyond the point of commutation of distance 4 in overlap region 3, which results in rotation of the arc. This reduces the specific thermal stress on the electrode. Only a small amount of consumption occurs and the switching capability of the gap path is noticeably greater compared to an arrangement having a stationary arc.

Figure 2B:
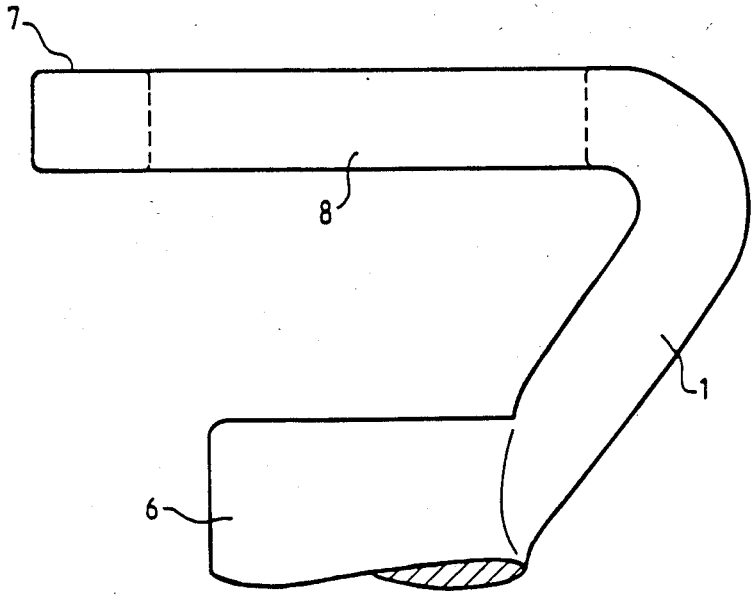

FIG. 2*a* and 2*b* show an embodiment of the invention in which the contact element 5 has one electrode 8. The free distal end 5 of the electrode 8 is tapered and bends around so that it inwardly overlaps the proximal end 1. In the region of overlap 3, the two ends are almost parallel. The distal end 5 is spaced from the proximal end 1 so that there is a small gap 4 between the two ends. The gap 4 is substantially smaller than the width of the electrode 8. A current is conducted through the proximal end or lead 1 which is connected to a shaft 6. A contact surface 7 on the electrode 8 allows the contact element 12 to cooperate with an opposing contact element (not shown).

FIGS. 3*a* and 3*b* show the basic structure of a contact element with a loop-shaped conductor path 30. The contact element 22 is made up of the three electrodes 8′, 8″ and 8‴ each having a corresponding proximal end 1′, 1″ and 1‴, distal end 5′,5″ and 5‴, and contact surface 7′ (not visible in FIG. 3*b*), 7″ and 7‴, respectively. Together, the individual contact surfaces 7′, 7″ and 7‴ form the contact surface for the contact element 22. Each of the distal ends 5′, 5″ and 5‴ inwardly overlaps an adjacent proximal end at a corresponding region of overlap 3′, 3″ or 3‴. In the regions of overlap the two adjacent ends are almost parallel. A small gap separates each distal end from the proximal end it overlaps. A current is conducted through the proximal ends 1′, 1″ and 1‴ which are connected to a shaft 6. This arrangement produces a reduction in mechanical stress during turn-on since the developing forces are not absorbed by only one, but by three relatively elastic leads 1′, 1″, 1‴. Of course, such a contact element may also be composed of two or any number of sections.

The contact elements may have an approximately circular configuration or may be in the form of a Carrera curve, i.e. a shape formed of two identical semi-circles with straight lines therebetween. FIG. 4 shows a schematic representation of the configuration of a contact element in the shape of a Carrera curve. This is a shape formed by two identical semi-circles with straight lines therebetween. The overlap region 3 is preferably arranged at the straight lines. The other parts are identical to FIG. 1.

The present disclosure relates to the subject matter disclosed in the Federal Republic of Germany, P 36 44 453.7 filed on Dec. 24th, 1986.

It will be understood that the above description of the present invention is susceptible to various modifications, changes and adaptations, and the same are intended to be comprehended within the meaning and range of equivalents of the appended claims.

I claim:

1. A contact element for a power switch which, in order to open or close the switch, cooperates with an opposite element, with a transitory rotating electric arc forming between the contact element and the opposite element when the switch is operated, said contact element being in the shape of an open loop and comprising:

an electrode having a contact surface made of an electrically conductive material and capable of facing the contact surface of a cooperating opposite element, said electrode having a proximal end at which a current may be introduced to said electrode and a free distal end which curves around and inwardly overlaps said proximal end so that there is a gap between said distal end and said proximal end, said gap being substantially smaller than the width of the electrode.

2. A contact element for a power switch which, in order to open or close the switch, cooperates with an opposite element, with a transitory rotating electric arc forming between the contact element and the opposite element when the switch is operated, said contact element being in the shape of an open loop and comprising:

a plurality of electrodes, each said electrode having a contact surface made of an electrically conductive material, said contact surfaces together forming the contact surface of said contact element and capable of facing the contact surface of a cooperating opposite element, each said electrode having a proximal end at which a current may be introduced to said electrode and a free distal end which curves around and inwardly overlaps the proximal end of an adjacent electrode so that there is a gap between each said distal end and the proximal end each said distal end overlaps, each said gap being substantially smaller than the width of each said electrode.

3. A contact element as defined in claim 1, wherein the open loop is approximately circular.

4. A contact element as defined in claim 2, wherein the open loop is approximately circular.

5. A content element as defined in claim 1, wherein the open loop is approximately in the shape of a Carrera curve.

6. A contact element as defined in claim 2 wherein the open loop is approximately in the shape of a Carrera curve.

7. A contact element as defined in claim 1 wherein, said cooperating contact elements are disposed in a vacuum.

8. A contact element as defined in claim 2 wherein said cooperating contact elements are disposed in a vacuum.

9. A contact element as defined in claim 6 wherein said cooperating contact elements are disposed in a vacuum.

10. A contact element as defined in claim 1 wherein said cooperating contact elements are disposed in sulfur hexafluoride.

11. A contact element as defined in claim 2 wherein said cooperating contact elements are disposed in sulfur hexafluoride.

12. A contact element as defined in claim 6 wherein said cooperating contact elements are disposed in sulfur hexafluoride.

* * * * *